US008471447B2

(12) United States Patent
Kuepper

(10) Patent No.: US 8,471,447 B2
(45) Date of Patent: Jun. 25, 2013

(54) AUTOMOTIVE HEADLAMP HAVING IMPROVED BRIGHT/DARK CUTOFF

(75) Inventor: Lukas Kuepper, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 35 days.

(21) Appl. No.: 13/002,084

(22) PCT Filed: Jul. 1, 2009

(86) PCT No.: PCT/IB2009/052856

§ 371 (c)(1),
(2), (4) Date: Dec. 30, 2010

(87) PCT Pub. No.: WO2010/004483

PCT Pub. Date: Jan. 14, 2010

(65) Prior Publication Data

US 2011/0109219 A1 May 12, 2011

(30) Foreign Application Priority Data

Jul. 7, 2008 (EP) ..... 08104650

(51) Int. Cl.
*F21S 8/10* (2006.01)
*H01K 1/30* (2006.01)

(52) U.S. Cl.
USPC ..... 313/117; 313/113; 362/538; 362/460; 362/464

(58) Field of Classification Search
USPC ..... 313/378–379, 341, 578–579, 113, 313/117; 362/460, 464, 459, 538
See application file for complete search history.

(56) References Cited

U.S. PATENT DOCUMENTS

2007/0108882 A1 5/2007 Schneider, Jr. et al.
2009/0051287 A1 * 2/2009 Bunk et al. ..... 313/579

FOREIGN PATENT DOCUMENTS

GB 1141984 A 2/1969
GB 2313706 A 12/1997
WO 2005112075 A1 11/2005
WO 2006027642 A2 3/2006
WO WO 2008032258 A1 * 3/2008

* cited by examiner

*Primary Examiner* — Karabi Guharay

(57) ABSTRACT

It is provided a lamp (12) for an automotive headlamp (10), comprising a filament coil (14) for emitting light (22) and a nominal alignment axis (32) for aligning the filament coil (14) such, that the filament coil (14) is positioned in the middle of an allowable tolerance box wherein the filament coil (14) is arranged shifted to the nominal alignment axis (32). Due to the shifted arrangement of the filament coil (14) the flexibility given by the allowable tolerance may be used for positioning the filament coil (14) such, that the projected image (18) of the filament coil (14) is projected nearer to the bright/dark-cutoff (40) without blinding oncoming traffic.

19 Claims, 2 Drawing Sheets

AUTOMOTIVE HEADLAMP HAVING IMPROVED BRIGHT/DARK CUTOFF

FIELD OF THE INVENTION

The invention relates to the field of lamps, which can be used for automobile headlamps.

BACKGROUND OF THE INVENTION

Lamps, particularly of the H7-type, may be arranged within an automobile headlamp in such a manner that the image of its filament coil is projected in a defined manner by means of an adequate reflector. The emitted light should illuminate mainly the lane of the driver and partially the lane of the oncoming traffic. Due to the specific design of the headlamp and of the reflector a defined bright/dark-cutoff is provided preventing a blinding of an oncoming driver. Since it is important not to blind an oncoming driver the position of the filament coil have to be very accurate and have to be positioned only within a given small tolerance box. In order to prevent a misalignment of the filament coil during the production process of the lamp the usually mainly tubular filament coil is arranged along a nominal alignment axis in the middle of the tolerance box. The nominal alignment axis is usually coaxial arranged with respect to a bulb and a socket of the lamp.

There is an instant need to provide more light nearer to the bright/dark-cutoff without blinding oncoming traffic.

SUMMARY OF THE INVENTION

It is an object of the invention to provide a lamp for an automotive headlamp, which provides more light nearer to the bright/dark-cutoff without blinding oncoming traffic.

This object is achieved by a lamp for an automotive headlamp, comprising a filament coil for emitting light and a nominal alignment axis for aligning the filament coil such, that the filament coil is positioned in the middle of an allowable tolerance box wherein the filament coil is arranged shifted to the nominal alignment axis.

Due to the shifted arrangement of the filament coil the flexibility given by the allowable tolerance may be used for positioning the filament coil such, that the projected image of the filament coil is projected nearer to the bright/dark-cutoff without blinding oncoming traffic. The shift may be up/down, left/right and/or forward/backward. Production accuracy is sufficient to benefit from the given allowable tolerances. Particularly the luminance near to the bright/dark-cutoff is increased, so that a high visibility particularly at a farer distance is given without affecting the lift time of the lamp. The luminance in the distance is increased without decreasing the life time of the lamp or overpowering the lamp. Further the maximum beam range of the lamp can be increased without affecting the life time of the lamp. The maximum beam range may be increased by approximately 10 m. Particularly it is possible to replace existing lamps by the lamp according to the invention without the need to redesign the automotive headlamp by which the lamp is held. The lamp according to invention can be used for reflection systems as well as for projection systems.

Particularly the filament coil is arranged such shifted to the nominal alignment axis, that the projected image of the filament coil is positioned closer to an intended bright/dark-cutoff of the headlamp. Due to the shift of the filament coil in vertical direction the projected image of the filament coil can be positioned closer to the bright/dark-cutoff. Particularly the amount of the shift of the filament coil is chosen such, that an outer border of the projected filament coil touches the bright/dark-cutoff. Since the projected image of the filament coil does not exceed the bright/dark-cutoff an aperture for absorbing potentially blinding light is unnecessary.

Preferably the filament coil is arranged lower or higher with respect to the nominal alignment axis. Due to the lower arrangement the projected image of the filament coil is projected higher in a reflection system and thus closer to the bright/dark-cutoff. For use in a projection system it is preferred to arrange the filament coil higher due to the image reversal of the provided lens. Since the nominal alignment axis is usually arranged coaxial to the bulb and the socket of the lamp, it is enough space present for the shifted filament coil.

Particularly the filament coil is arranged right or left in horizontal direction with respect to the nominal alignment axis. When the filament coil is shifted right looking in emitting direction the luminance at the right roadway border is increased for a better view of traffic signs. Since the bright/dark-cutoff on the right site is preferably not horizontal but increasing by approximately 15° a higher luminous flux on the right site may lead to a more homogenous illumination. For use in a projection system it is preferred to shift the filament coil left due to the image reversal of the provided lens.

In a preferred embodiment the filament coil comprises a coil axis arranged shifted to the nominal alignment axis by a distance s of 0.05 mm$\leqq$s$\leqq$0.40 mm, particularly 0.10 mm$\leqq$s$\leqq$0.30 mm, preferably 0.15 mm$\leqq$s$\leqq$0.25 mm and most preferred s=0.2 mm±0.02 mm. Due to this distance the allowable tolerance box for providing the filament coil is met and an increased luminance in the distance and nearer to the bright/dark-cutoff is provided.

Particularly the filament coil comprises a diameter, which is lowered in dependence to the amount of the displacement of the filament coil to the nominal alignment axis. As much as the filament coil is shifted the diameter of the filament coil can be lowered or vice versa. Due to the smaller diameter a greater amount for the shift of the filament coil is acceptable for meeting the tolerance box and providing the outer border of the filament coil closer to the bright/dark-cutoff. Since the middle of the filament coil is projected closer to the bright/dark-cutoff the luminance in the distance is further increased.

Preferably the filament coil comprises a diameter d of 0.90 mm$\leqq$d$\leqq$1.20 mm, particularly 1.00 mm$\leqq$d$\leqq$1.15 mm and preferably 1.05 mm$\leqq$d$\leqq$1.10 mm. Due to this diameter a compact and slim design of the filament coil is provided without the danger of too much heat inside the filament coil.

Particularly the filament coil comprises a length, which is elongated in dependence to the amount of the displacement of the filament coil to the nominal alignment axis and/or to the amount of a lowered diameter of the filament coil. The length of the filament coil may be adapted such to the diameter of the filament coil that an unchanged luminous flux is given. Depending of the diameter of the filament coil the number of windings and/or the distance between neighboring windings of the filament coil may be increased, decreased or constant. The length of the filament coil may be adapted to the shift of the filament coil such, that the luminance at a specific point, preferably the point of most brightness, is kept unchanged, so that only the luminance of the other areas, particularly close to the bright/dark-cutoff are increased.

Preferably the filament coil comprises a length l of 4.10 mm$\leqq$l$\leqq$4.70 mm, particularly 4.20 mm$\leqq$l$\leqq$4.60 mm, preferably 4.30 mm$\leqq$l$\leqq$4.55 mm and most preferred 4.40 mm$\leqq$l$\leqq$4.50 mm. With respect to a halogen lamp, particularly of the H7-type, this length of the filament coil may be easily provided inside the bulb of the lamp.

Particularly a bulb for receiving the filament coil and a socket to which the filament coil and the bulb is connected are provided, wherein the nominal alignment axis is arranged coaxial to the bulb and/or the socket. Since the nominal alignment axis is usually arranged in the middle of the bulb, the shifted filament coil is arranged eccentric. Since the filament coil may be arranged lower with respect to the nominal alignment axis in gravity direction more space for natural convection is given leading to an increased cooling and a longer life time.

Preferably the filament coil is adapted for emitting light of a luminous flux of 1500 lm±150 lm. This leads to a design rule for changing the diameter and the length of the filament coil. Since the luminous flux is kept constant at mainly 1500 lm the lamp meet the H7-type standard for the luminous flux.

The invention further relates to a headlamp for an automobile comprising a lamp, which may be designed as previously described. Particularly a reflector for providing a defined bright/dark-cutoff of the headlamp is provided. The bright/dark-cutoff as well as the illuminated area may be adapted by the shape of the reflector. In addition or in alternate a lens system may be provided for guiding the light beams of the lamp. Preferably the filament coil is positioned such, particularly with respect to the reflector, that the luminance in a distance of 75 m to the headlamp is increased by at least 5%, particularly at least 7.5% and preferably 10% in comparison to an unshifted filament coil. Thus the beam range in the low beam may be improved by roughly 10 m leading to an increased visibility in the distance, where it is difficult to provide sufficient luminance.

BRIEF DESCRIPTION OF THE DRAWINGS

These and other aspects of the invention will be apparent from and elucidated with reference to the embodiments described hereinafter. In the drawings.

DETAILED DESCRIPTION OF EMBODIMENTS

Figure 1:
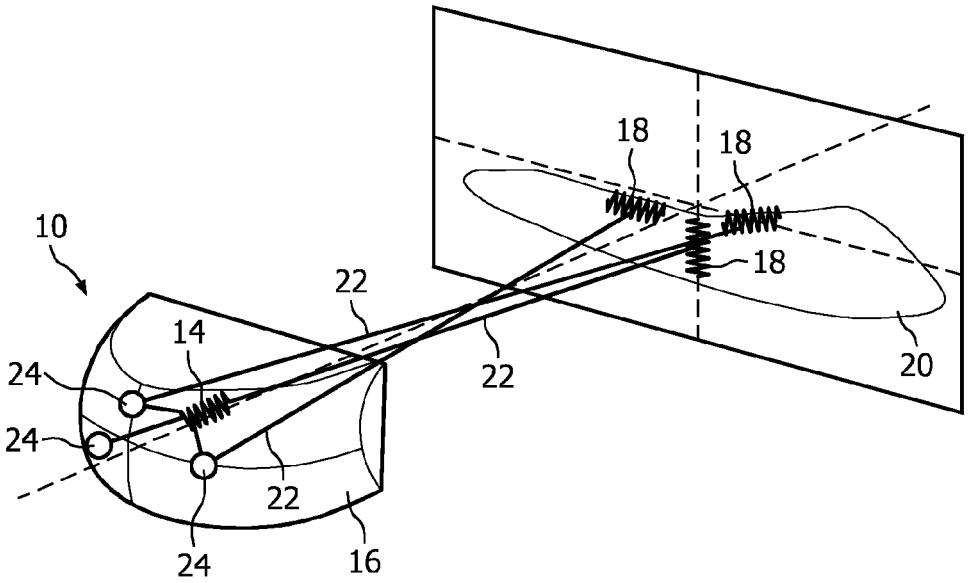
FIG. 1 is a schematic principle view of the light beams of an automotive lamp.

As illustrated in FIG. 1 an automotive headlamp 10 comprises a lamp 12 with a filament coil 14 arranged within a reflector 16 comprising several reflector segments 24. Every reflector segment 24 of the reflector 16 reflects light beams 22 of the filament coil 14 and generates an image 18 of the filament coil 14 for illuminating an illuminating area 20.

Figure 2:
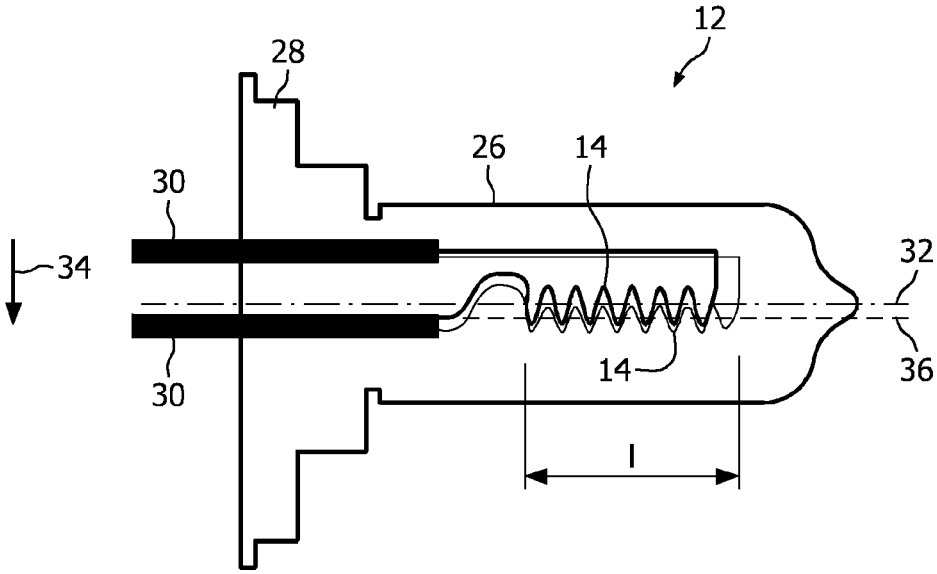
FIG. 2 is a schematic overlapped view of a lamp according to the state of the art and a lamp according to the invention and FIG. 3 is a schematic overlapped view of the illuminated area of a lamp according to the state of the art and a lamp according to the invention.

As illustrated in FIG. 2 the lamp 12 comprises a bulb 26 connected to a socket 28. The filament coil 14 is arranged inside the bulb 26 and electrically connected to connectors 30. The lamp 12 comprises a nominal alignment axis 32 arranged mainly coaxial to the bulb 26 and the socket 28. A filament coil 14 according to the state of the art (bold lines) is arranged coaxial to the nominal alignment axis in the middle of an allowable tolerance box for positioning the filament coil 14. A filament coil 14 according to the invention (fine lines) is positioned shifted in gravity direction 34 with respect to the nominal alignment axis 32. A coil axis 36 of the shifted filament coil 14 is arranged mainly parallel to the nominal alignment axis 32. The coil axis 36 of the shifted filament coil 14 is spaced to the nominal alignment axis by a distance s (not illustrated). The shifted filament coil 14 comprises a smaller diameter d (not illustrated) and a greater length l in comparison to the unshifted filament coil 14.

Figure 3:
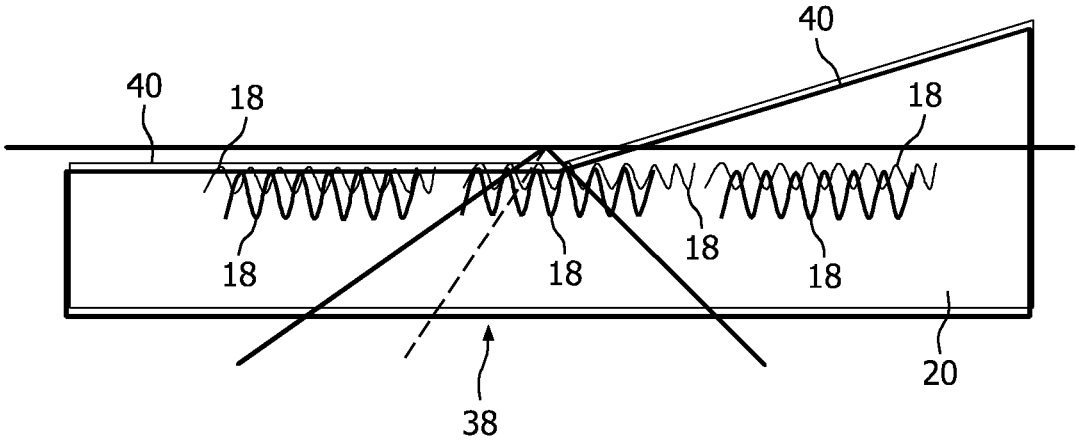

As illustrated in FIG. 3 the illuminated area 20 of the shifted filament coil 14 (fine lines) is nearly the same as the illuminated area 20 of the unshifted filament coil 14 (bold lines). A roadway 38 may be illuminated by the projected images 18 of the filament coil 14 as well as a part of the right roadway border for illuminating traffic signs. Due to the shifted filament coil 14 and the smaller diameter the luminance close to a bright/dark-cutoff 40 is higher so that more light in the distance without blinding oncoming traffic is possible leading to an improved visibility without the need to change the design of the headlamp 10.

While the invention has been illustrated and described in detail in the drawings and foregoing description, such illustration and description are to be considered illustrative or exemplary and not restrictive; the invention is not limited to the disclosed embodiments. For example, it is possible to operate the invention in an embodiment wherein more than one filament coil 14 is provided in a bulb or more than one lamp 12 is provided within one headlamp 10. Further the design of the headlamp 10 and the reflector 16 may be adapted to the shifted filament coil 14 for further reducing the risk of blinding oncoming traffic. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. Lamp for an automotive headlamp, comprising a nominal alignment axis and a filament comprising a coil for emitting light, wherein the filament coil is positioned in the middle of an allowable tolerance box with respect to the alignment axis;

wherein the filament coil is arranged shifted relative to the nominal alignment axis such that the filament coil is arranged in a manner that a projected image of the filament coil continuously touches a bright/dark cutoff of the headlamp when in operation.

2. Lamp according to claim 1 wherein the filament coil is arranged lower or higher with respect to the nominal alignment axis.

3. Lamp according to claim 1 wherein the filament coil is arranged right or left in horizontal direction with respect to the nominal alignment axis.

4. Lamp according to claim 1 wherein the filament coil-comprises a coil axis arranged shifted relative to the nominal alignment axis by a distance s of $0.05\ mm \leqq s \leqq 0.40\ mm$.

5. Lamp according to claim 1 wherein the filament coil comprises a diameter, which diameter is reduced in size by an amount less than or equal to the amount of the displacement of the filament coil to the nominal alignment axis.

6. Lamp according to claim 1 wherein the filament coil comprises a diameter d of $0.90 \leqq d \leqq 1.20\ mm$.

7. Lamp according to claim 1 wherein the filament coil comprises a length, which length is increased in size by the amount of the displacement of the filament coil to the nominal alignment axis.

8. Lamp according to claim 1 wherein the filament coil comprises a length l of 4.10 mm≦l≦4.70 mm.

9. Lamp according to claim 1 wherein a bulb for receiving the filament coil and a socket to which the filament coil and the bulb is connected are provided, wherein the nominal alignment axis is arranged coaxial to the bulb and/or the socket.

10. Headlamp for an automobile comprising a lamp according to claim 1.

11. Headlamp according to claim 10 wherein a reflector for providing a defined bright/dark-cutoff of the headlamp is provided.

12. Headlamp according to claim 11 wherein the filament coil is positioned such particularly with respect to the reflector, that in use, luminance in a distance of 75 m to the headlamp is increased by at least 5% in comparison to an unshifted filament coil.

13. Headlamp according to claim 11 wherein the filament coil is positioned such particularly with respect to the reflector, that in use, luminance in a distance of 75 m to the headlamp is increased by at least 10% in comparison to an unshifted filament coil.

14. Lamp according to claim 1 wherein the filament coil comprises a coil axis arranged shifted relative to the nominal alignment axis by a distance s of s=0.2 mm±0.02 mm.

15. Lamp according to claim 1 wherein the filament coil comprises a diameter d of 1.05 mm≦d≦1.10 mm.

16. Lamp according to claim 1 wherein the filament coil comprises a length l of 4.40 mm≦l≦4.50 mm.

17. Method of manufacturing a lamp for an automotive headlamp, the lamp comprising a nominal alignment axis, said method comprising the steps of providing a filament comprising a coil for emitting light, positioning the filament coil in the middle of an allowable tolerance box with respect to the nominal alignment axis;

shifting the filament coil relative to the nominal alignment axis such that the filament coil is arranged in a manner that a projected image of the filament coil continuously touches a bright/dark cutoff of the headlamp when in operation.

18. Method according to claim 17 wherein said shifting step comprises shifting in a vertical direction of the filament coil with respect to the nominal alignment axis.

19. Method according to claim 17 wherein said shifting step comprises shifting in a horizontal direction of the filament coil with respect to the nominal alignment axis.

* * * * *